United States Patent [19]

Cappell et al.

[11] Patent Number: 4,959,978

[45] Date of Patent: Oct. 2, 1990

[54] PROGRAMMABLE PUSHBUTTON COMBINATION LOCK

[76] Inventors: Mitchell G. Cappell, 64 Samuel Oster Avenue, Thornhill, Ontario, Canada, L4J 7C8; Malcolm Stephens, 188 Lester Street, Apt. 26B, Waterloo, Ontario, Canada, N2L 3W4

[21] Appl. No.: 424,722

[22] Filed: Oct. 20, 1989

[51] Int. Cl.[5] ..... E05B 37/16

[52] U.S. Cl. ..... 70/25; 70/298; 70/319

[58] Field of Search ..... 70/288, 298, 300, 315, 70/316, 317, 318, 319, 25, 26

[56] References Cited

U.S. PATENT DOCUMENTS

| | | | |
|---|---|---|---|
| 1,401,030 | 12/1921 | Ashkar | 70/300 |
| 4,114,408 | 9/1978 | Gee | 70/316 |
| 4,191,035 | 3/1980 | Hatch | 70/298 |
| 4,660,394 | 4/1987 | Wu | 70/25 |
| 4,671,084 | 6/1987 | Lin | 70/25 |
| 4,748,833 | 6/1988 | Nagasawa | 70/298 |
| 4,754,623 | 7/1988 | Hwang | 70/25 |

*Primary Examiner*—Robert L. Wolfe

*Attorney, Agent, or Firm*—Carson, Armstrong

[57] ABSTRACT

A combination lock or padlock having pushbuttons where the combination of buttons to be pushed to open the lock is mechanically programmable by the user is disclosed. The lock has a case and a locking arm and associated slider, moveable between a locked and unlocked position. A plurality of buttons project from at least one side of the case, and are owner-reversible between two orientations and moveable through holes in the case between first and second positions. In one orientation, movement of the locking means is barred in the first position and permitted in the second position, and in the other orientation movement is permitted in the first position and barred in the second position. The orientation of any button is not being visually ascertainable from outside the case, so the lock owner can program the combination of the lock by selecting the orientation of the respective buttons.

2 Claims, 4 Drawing Sheets

PROGRAMMABLE PUSHBUTTON COMBINATION LOCK

BACKGROUND OF THE INVENTION

1. Field of the Invention

This invention relates generally to combination locks, and particularly to a combination lock having pushbuttons where the combination of buttons to be pushed to open the lock is mechanically programmable by the user.

The invention has as a particular application a combination padlock, but the locking mechanism and principles of the invention can be readily adapted to other uses such as door locks, safe locks, etc..

2. Description of the Prior Art

Pushbutton combination padlocks are known. For example, see U.S. Pat. Nos. 4,660,394 and 4,671,084.

Combination locks having a user-changeable combination are also known. For example, see U.S. Pat. No. 4,754,623.

However, the present inventors are not aware of any pushbutton-type combination lock in which the user can readily change the combination in the manner of the invention.

SUMMARY OF THE INVENTION

It is an object of the invention to provide an improved combination lock having pushbuttons where the combination of buttons to be pushed to open the lock is mechanically programmable by the user.

Thus in accordance with the present invention there is provided a pushbutton combination lock having a case, and locking means including a locking arm within and projecting from the case. Buttons project from the case normal to the direction of movement of the locking means, and are owner-reversible between two orientations, and moveable through holes in the case between first and second positions such that in one orientation, movement of the locking means is barred in the first position and permitted in the second position, and in the other orientation movement of the locking means is permitted in the first position and barred in the second position. The orientation of any button is not visually ascertainable from outside the case, so the lock owner can program the combination of the lock by selecting the orientation of the respective buttons.

Further features of the invention will be described or will become apparent in the course of the following detailed description.

BRIEF DESCRIPTION OF THE DRAWINGS

In order that the invention may be more clearly understood, the preferred embodiment thereof, in the form of a padlock, will now be described in detail by way of example, with reference to the accompanying drawings, in which.

DETAILED DESCRIPTION OF THE PREFERRED EMBODIMENT

Figure 1:
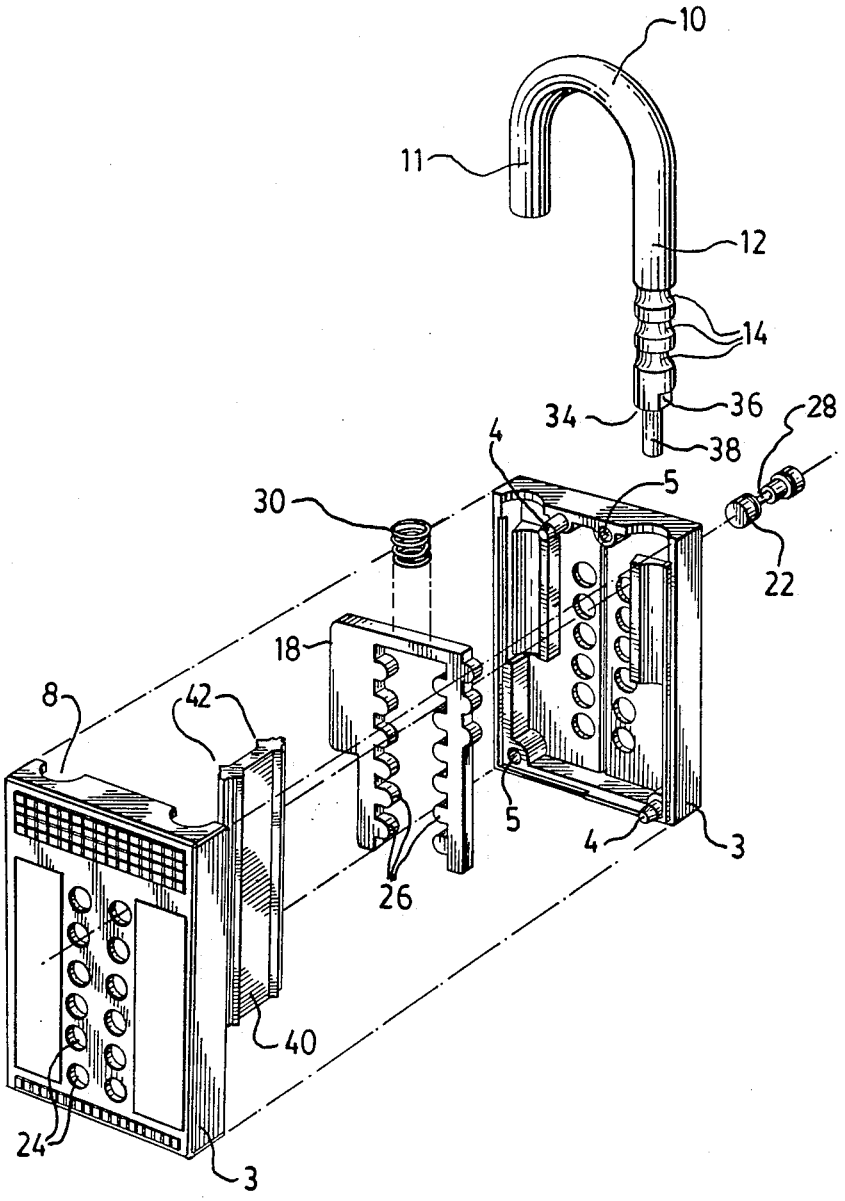
FIG. 1 is an exploded perspective of the lock.
Figure 2:
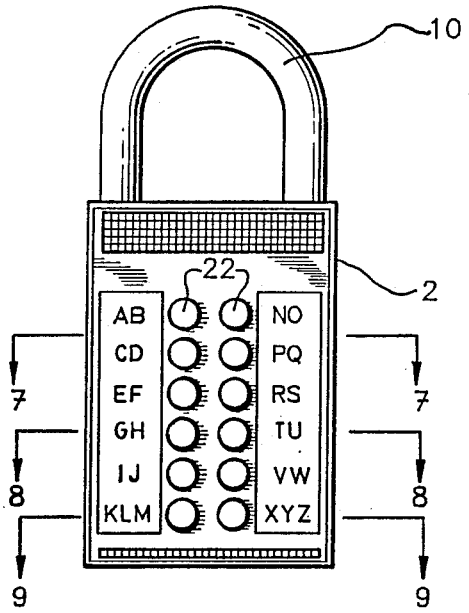
FIG. 2 is a front view of the lock.
Figure 3:
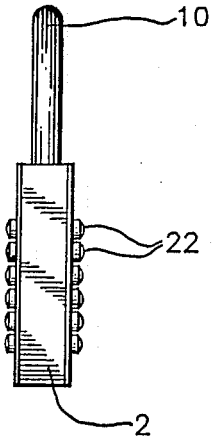
FIG. 3 is a side view of the lock.

Die-cast body has 2 halves 3 which mate together by virtue of posts 4 in one half which project into cylindrical female portions 5 in the other half. Preferably, for ease of manufacturing, the halves are structurally identical.

The top of the body has openings 8 near its outer edges for the U-shaped locking arm 10, the short arm 11 of the U-shape moving into and out of the body in the usual fashion of a padlock, representing the locked and unlocked positions respectively, the long arm 12 moving within the body between the locked and unlocked positions, and including three notches 14 which are engaged in the locked position by corresponding projections 16 from a slider 18.

Figure 4:
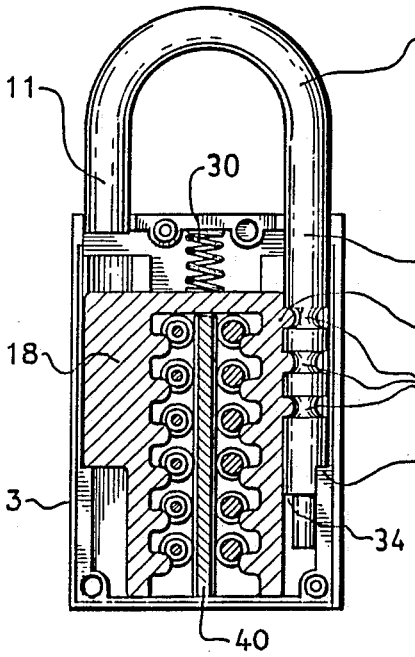
FIG. 4 is a front view of the lock, in the locked position, with one of the body halves removed to expose the interior of the lock.
Figure 5:
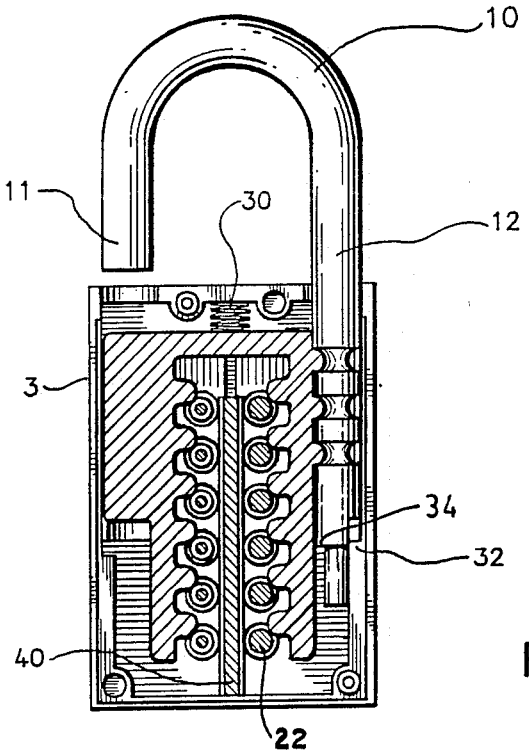
FIG. 5 is view corresponding to FIG. 4, but showing the unlocked position.
Figure 6:
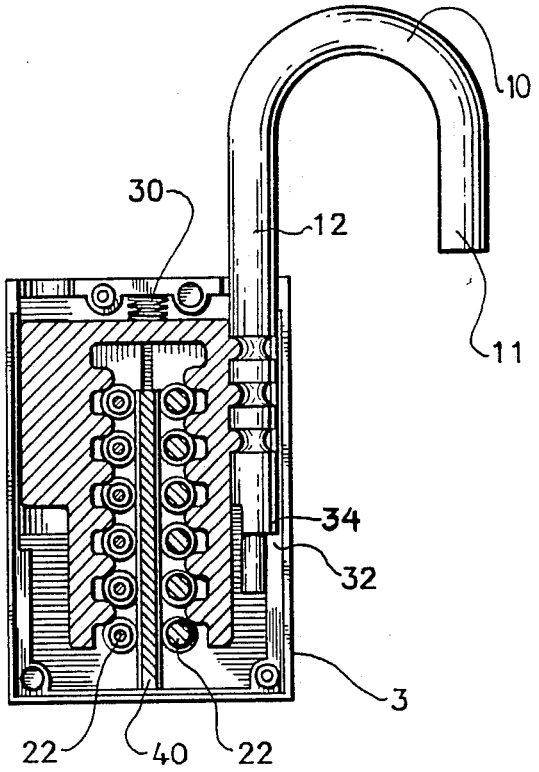
FIG. 6 is view corresponding to FIG. 4, but showing the "change code" position.

The slider 18 is capable of moving up and down within the body between three positions, namely locked, unlocked, and "change code" (FIGS. 4, 5 and 6 respectively).

In the locked position, the first notch 36 sits on the shoulder 32. In the unlocked position, with the locking arm not rotated, the second notch 34 sits slightly below the shoulder 32, and the spring 30 positioned between the slider and the inside top of the body is partially compressed. When the locking arm is lifted to further compress the spring 30, the slider moves to the "change code" position. When the locking arm is then rotated 180 degrees, the second notch 34 sits on the shoulder to hold the mechanism in that position to facilitate a code change.

In an alternative embodiment, not specifically illustrated but virtually identical to the preferred embodiment, rotation of the locking arm does not hold the slider in the change code position, because a gap is left between the second notch 34 and the shoulder 32. To get the slider to the change code position, the locking arm 10 must be manually held in the change code position against the force of the spring 30.

The body has a number of preferably cylindrical holes 24 passing through both sides, and arranged in at least one vertical row. The slider includes a corresponding number of projections 26, projecting slightly into the axial plane of the holes.

In order for the locking arm 10 and slider 18 to be moveable from the locked position, where the slider projections 26 are slightly below each hole, to the unlocked position where the projections are slightly above each hole, the projections must be able to pass partially through the hole.

Figure 7:
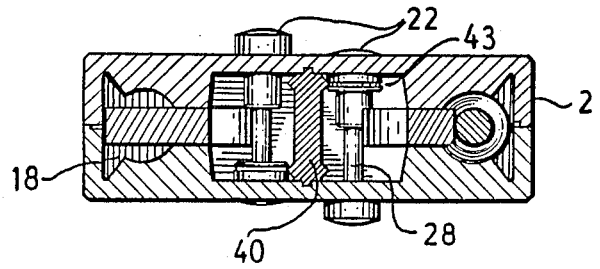
FIG. 7 is a top view, in section through 7—7 of FIG. 2.
Figure 8:
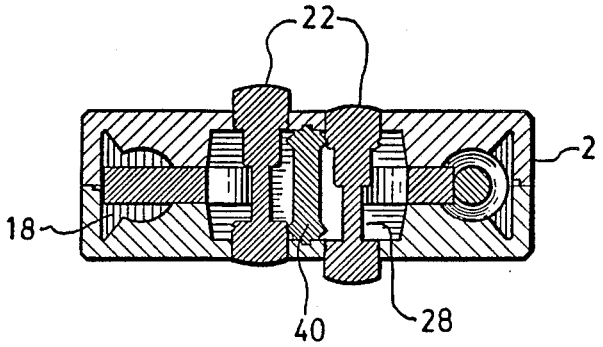
FIG. 8 is a top view, in section through 8—8 of FIG. 2.
Figure 9:
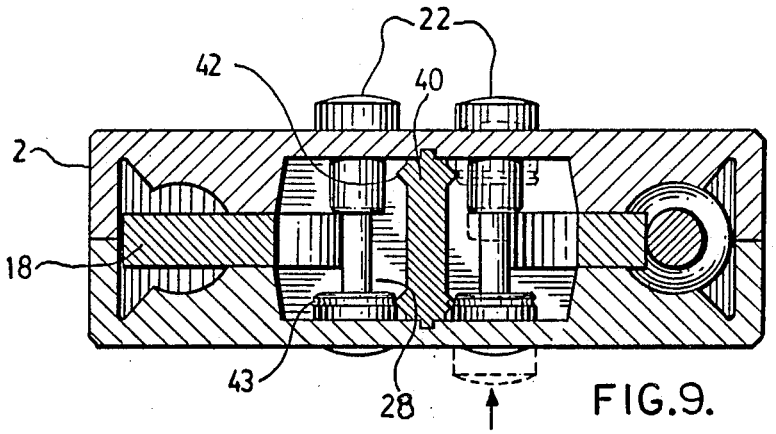
FIG. 9 is a top view, in section through 9—9 of FIG. 2.

Each hole has a button 22, moveable between a position where it projects from one side of the body and is flush with the other, to a position where it projects from the other side and is flush with the first side. As seen in FIG. 1 and more clearly in FIGS. 7–9, each button has a relatively small diameter portion 28 nearer one end than the other. It is when this small diameter portion aligns with the plane of the slider projection 26 that the slider can move from the locked to the unlocked position. A keeper 40 has ridges 42 which snap into grooves 43 in the buttons to loosely retain them at each position.

In positions other than "change code", the buttons are prevented from travelling beyond their two positions by virtue of the slider projections 26 contacting the larger diameter portion of the buttons. In the change code position, the button can be readily extracted from the hole and reversed, to thereby change the code.

Externally, both ends of each button have the same appearance. Therefore, the user has no way of knowing which end of the button the small diameter position is closest to, that being the end which must be pressed flush to the body surface to align the small diameter portion with the slider projection. By orienting some buttons one way, and some the other, a combination or code can thus be set.

It will be readily appreciated that the number of buttons is not critical. Obviously, the greater the number of buttons, the greater the number of possible codes or combinations, and the more difficult it is to break the code. The number of possible combinations is simply $2^x$, where x is the number of buttons. Thus for the 12-button embodiment illustrated, there are $2^{12}$ possible combinations, or 4,096. Each button can be identified by a letter, a number, or any other suitable indicia, or the user could conceivably simply remember a particular pattern of buttons to be pushed.

Obviously, any number of rows and buttons per row could be conceived, although more than two rows may be impractical.

The holes 24 obviously need not be circular and the buttons need not be cylindrical, although of course the shape of the buttons needs to correspond to the shape of the holes.

As mentioned previously, the locking mechanism and principles of the invention can be readily adapted to other uses such as door locks, safe locks, etc.. In such other uses, instead of the locking mechanism being associated with the locking arm or shackle of a padlock, it could be connected to, for example, a deadbolt or latch or safe locking mechanism or the like.

The case need not have two accessible sides, with the buttons passing through both sides of the case. For example, the case could be flush-mounted against a door or door-frame, with the buttons accessible from one side only.

It will be appreciated that the above description relates to the preferred embodiment by way of example only. Many variations on the invention will be obvious to those knowledgeable in the field, and such obvious variations are within the scope of the invention as described and claimed, whether or not expressly described.

What is claimed as the invention is:

1. A pushbutton combination lock comprising:

a case;

locking means including a locking arm within and projecting from said case, said locking means and locking arm being moveable in linear fashion between a locked and an unlocked position;

a plurality of buttons projecting from the case normal to the direction of movement of said locking means, owner-reversible end-over-end between two orientations and moveable through holes in said case between first and second positions such that in one said orientation, movement of said locking means is barred in said first position and permitted in said second position, and in the other said orientation movement of said locking means is permitted in said first position and barred in said second position, the orientation of any button not being visually ascertainable from outside the case, whereby the lock owner can program the combination of the lock by selecting the orientation of the respective buttons.

2. A lock as recited in claim 1, in which said locking means includes a slider having a plurality of projections each projecting partially into the space of a button, and in which said buttons have notches to permit passage of said projections when said buttons are suitably positioned, to permit linear movement of said slider and said locking means when so positioned but otherwise to deny passage and thereby prevent movement of said slider and locking means.

* * * * *